US007950787B2

(12) United States Patent
Takahashi

(10) Patent No.: US 7,950,787 B2
(45) Date of Patent: May 31, 2011

(54) LIQUID EJECTION APPARATUS AND METHOD

(75) Inventor: Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 421 days.

(21) Appl. No.: 12/139,289

(22) Filed: Jun. 13, 2008

(65) Prior Publication Data

US 2008/0309691 A1 Dec. 18, 2008

(30) Foreign Application Priority Data

Jun. 14, 2007 (JP) ..... 2007-157880
Apr. 14, 2008 (JP) ..... 2008-104928

(51) Int. Cl.
*B41J 2/175* (2006.01)

(52) U.S. Cl. ..... 347/85

(58) Field of Classification Search ..... 347/7, 84–87
See application file for complete search history.

(56) References Cited

FOREIGN PATENT DOCUMENTS

| | | |
|---|---|---|
| JP | 09-076523 | 3/1997 |
| JP | 10-044468 | 2/1998 |
| JP | 11-286117 | 10/1999 |
| JP | 2000-015837 | 1/2000 |
| JP | 2004-314418 | 11/2004 |
| JP | 2006-175626 | 7/2006 |

*Primary Examiner* — An H Do
(74) *Attorney, Agent, or Firm* — Workman Nydegger

(57) ABSTRACT

A liquid ejection apparatus including a recording head capable of ejecting liquid, a first liquid storage unit which is replaceable which stores liquid to be ejected from the recording head, a second liquid storage unit which is integrally formed with the apparatus body which stores liquid to be ejected from the recording head, the liquid stored in the second liquid storage unit being the same kind of liquid as the liquid stored in the first liquid storage unit, and a selection-and-supply unit which selects at least one liquid from the liquid stored in the first liquid storage unit and the liquid stored in the second liquid storage unit and supplies the selected the liquid to the recording head.

12 Claims, 11 Drawing Sheets

LIQUID EJECTION APPARATUS AND METHOD

BACKGROUND OF THE INVENTION

The entire disclosure of Japanese Patent Application No. 2007-157880, filed Jun. 14, 2007 and Japanese Patent Application No. 2008-104928, filed Apr. 14, 2008 are expressly incorporated herein by reference.

TECHNICAL FIELD

The present invention relates to a liquid ejection apparatus and a liquid ejection method.

RELATED ART

One example of a liquid ejection apparatuses currently known in the art is disclosed in Japanese Patent No. JP-A-2006-175626, which discloses a printer in which a plurality of kinds of ink are alternately supplied to a head.

This kind of printer uses various types of ink stored in an ink cartridge for various uses. For example, when performing printing on paper, one ink is used for nozzle maintenance. Thus, different kinds of ink are supplied to a recording head in a switching manner. Accordingly, when ink stored in one particular cartridge falls below a predetermined amount, a new cartridge of the same color needs to be installed. Unfortunately, however, in some situations the amount of ink needed for the maintenance operations is greater than the amount of ink needed for the standard print operations. Unfortunately, however, the entire cartridge needs to be replaced when one type of ink is depleted, meaning that the cartridge must be frequently replaced.

BRIEF SUMMARY OF THE INVENTION

An advantage of some aspects of the invention is that it provides a liquid ejection apparatus which is easy to use.

One aspect of the invention is a liquid ejection apparatus including a recording head which ejects liquid, a first replaceable liquid storage unit disposed separate from the apparatus body which stores liquid to be ejected from the recording head, a second liquid storage unit which is integrally formed with the apparatus body and which stores liquid to be ejected from the recording head, the liquid stored in the second liquid storage unit being the same kind as the liquid stored in the first liquid storage unit, and a selection-and-supply unit which selects a liquid from the liquid stored in the first liquid storage unit and the liquid stored in the second liquid storage unit.

Other advantages and features of the invention will become apparent from description of the specification and illustration of the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

The following claims will be apparent from description of the specification and illustration of the accompanying drawings.

First Embodiment

Overall Structure of Printer 1

Figure 1A:
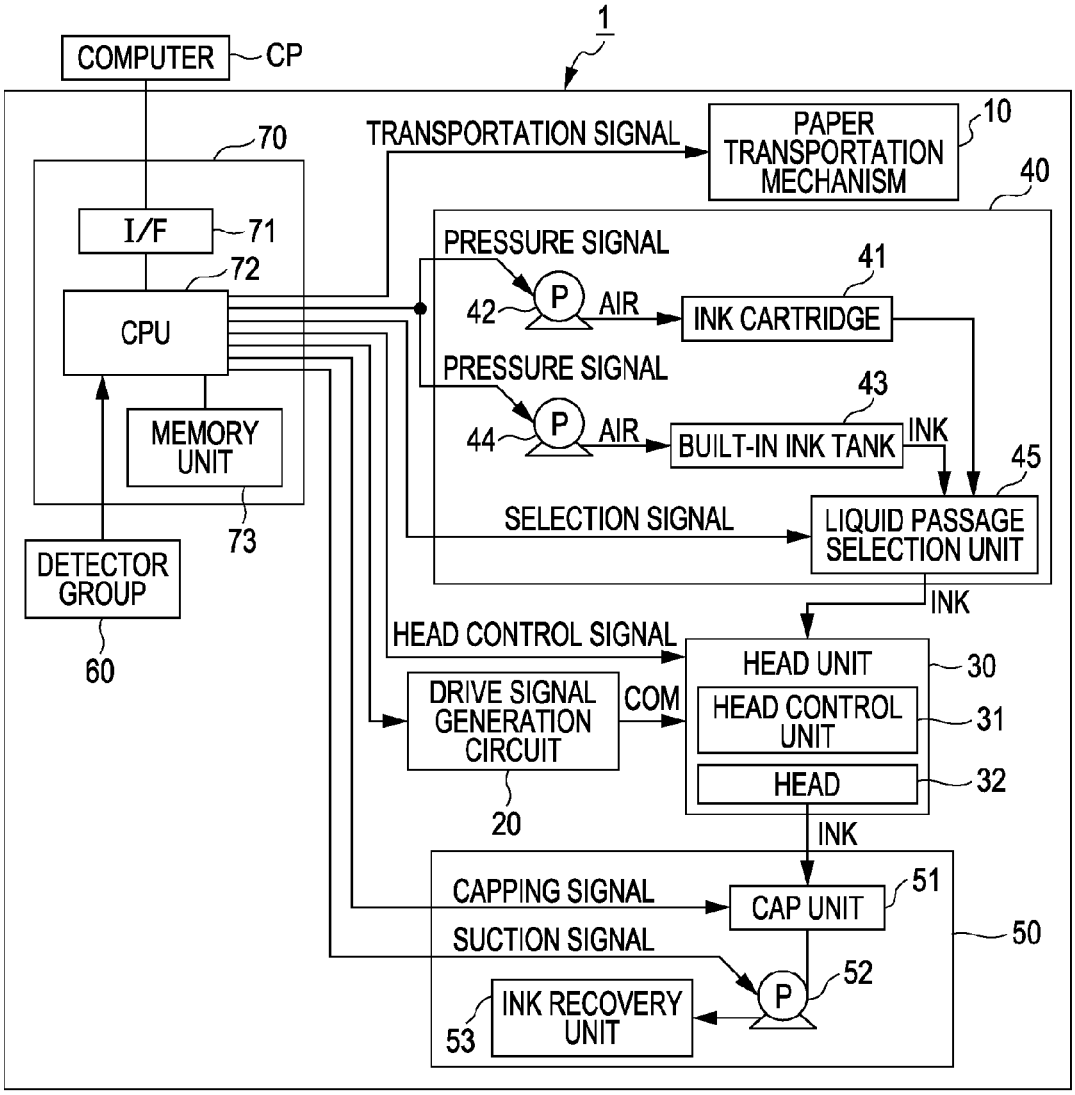
FIG. 1A is a block diagram illustrating a printer according to one embodiment of the invention.
Figure 1B:
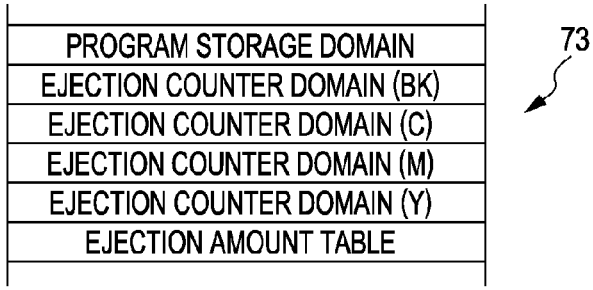
FIG. 1B illustrates a memory included in a controller of the printer.

FIG. 1A is a block diagram illustrating a printer 1, which is an example of a liquid ejecting apparatus capable of performing aspects of the present invention. FIG. 1B is a conceptual view used for explaining a partial domain of a memory 73 within a controller 70 on the printer side. The printer 1 includes a liquid ejection recording head which ejects ink which is a kind of liquid to a medium, such as paper, cloth, film, etc. As may be understood by one of skill in the art, ink includes both of water-based ink and oil-based ink, but the ink in the illustrative embodiments described herein, ink comprises water-based ink. In the present embodiment, the printer 1 ejects four colors of ink including black, cyan, magenta, and yellow ink. The medium is a target onto which the liquid is ejected. For example, the medium is paper S (see FIG. 2).

The printer 1 includes a paper transportation mechanism 10, a drive signal generation circuit 20, a recording head unit 30, an ink supply mechanism 40, an ink recovery mechanism 50, a detector group 60, and a printer controller 70.

Figure 2:
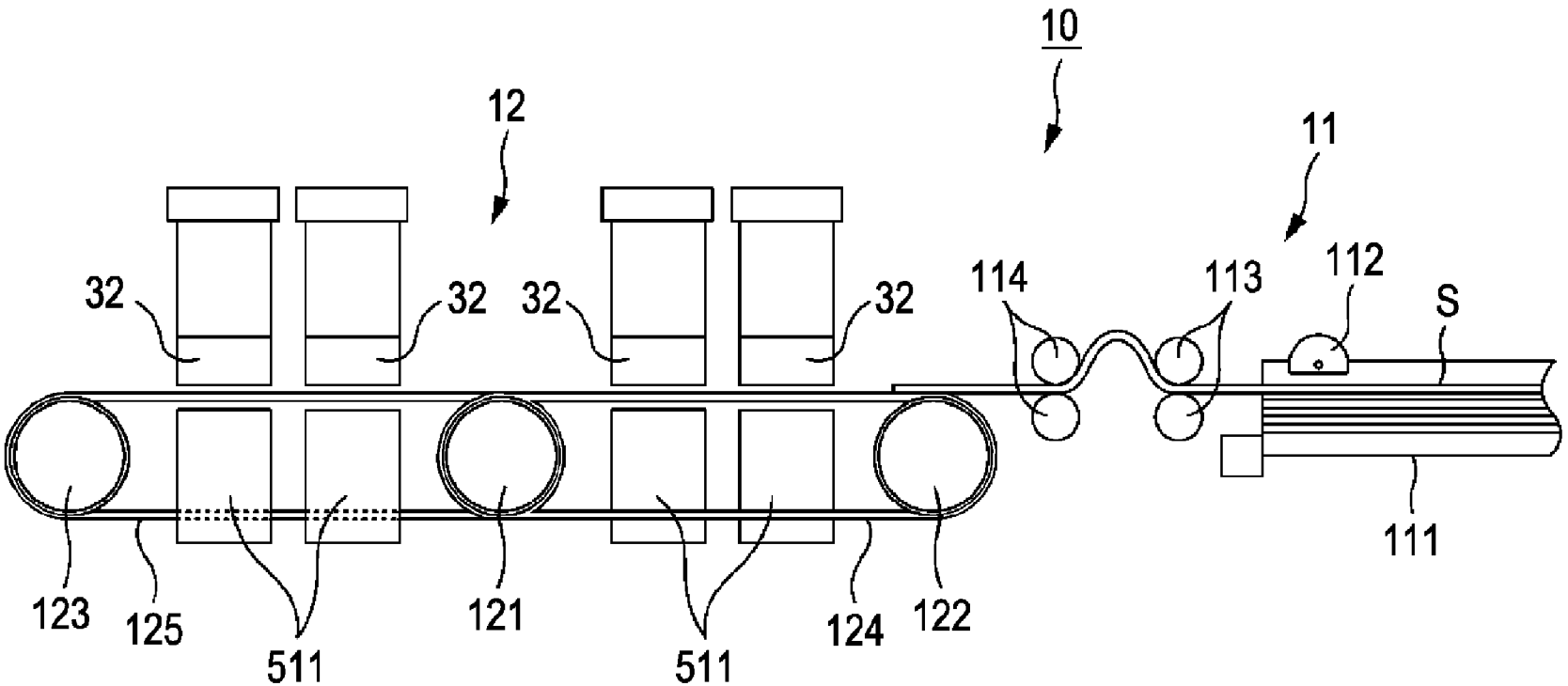
FIG. 2 illustrates a paper transporting mechanism of the invention.
Figure 4:
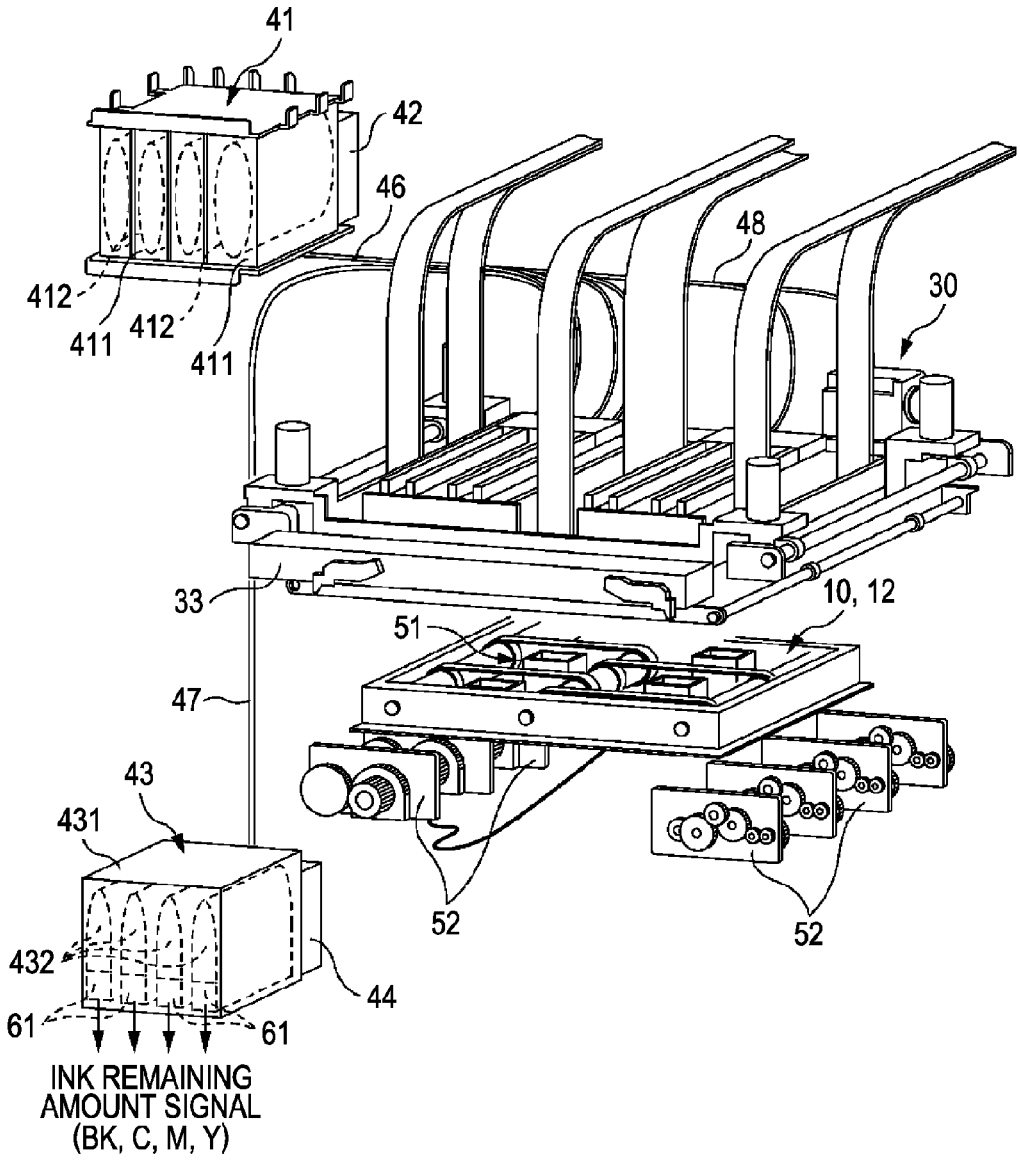
FIG. 4 is a perspective view illustrating a recording head unit of the printer and peripherals thereof.

The paper transportation mechanism 10 is a medium transportation unit 12 which transports the paper S serving as the medium in a predetermined transportation direction. As shown in FIG. 2, the paper transportation mechanism 10 includes a paper supply unit 11 and a paper transportation unit 12. The paper supply unit 11 is a section unit for supplying the paper S which is stacked to the paper transportation unit 12 and includes a paper tray 111, a pick-up roller 112, a feed roller 113, a gate roller 114, and a supply motor (not shown). As shown in FIG. 4, the paper transportation unit 12 is disposed so as to face the recording head unit 30.

Figure 3:
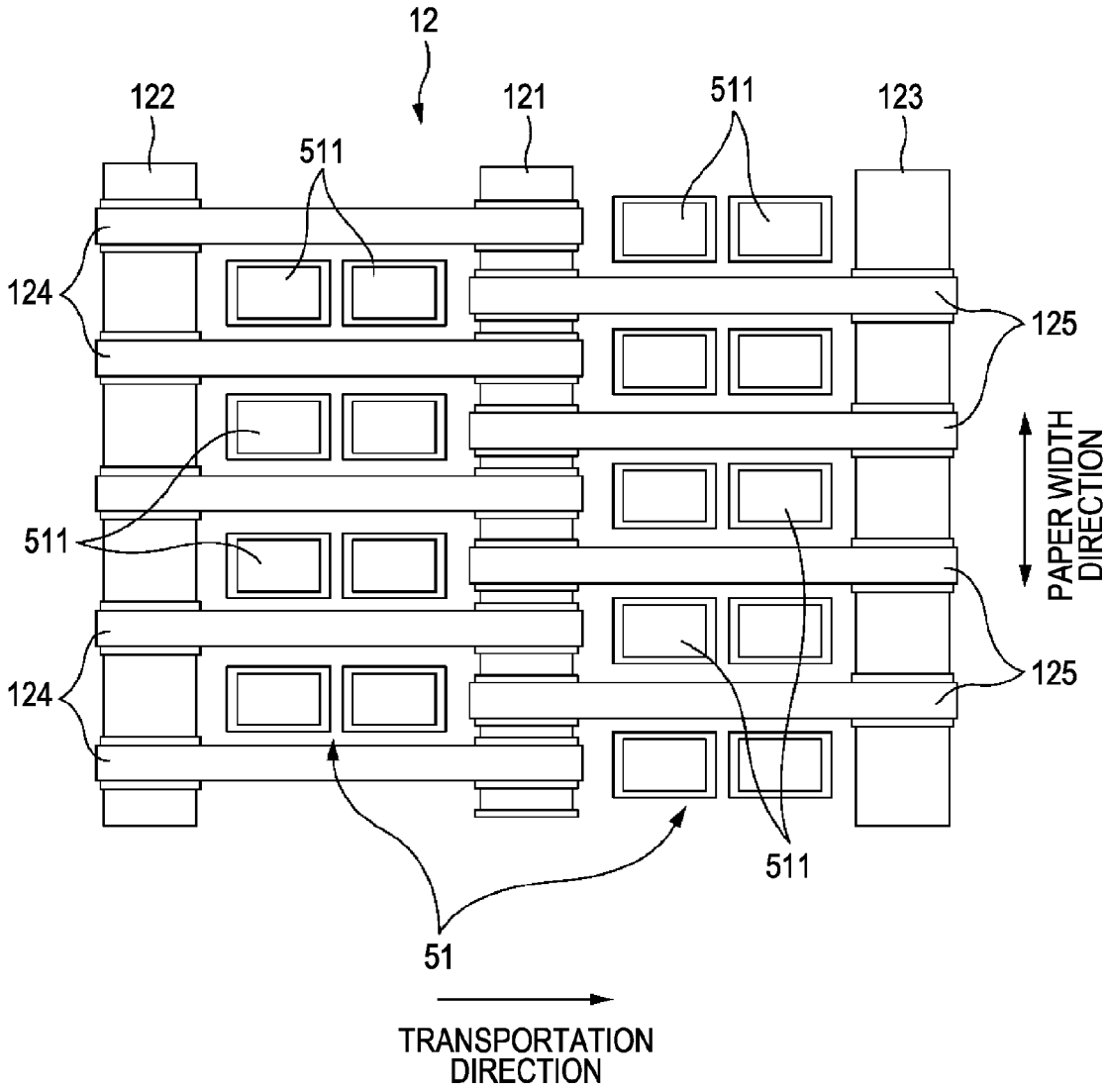
FIG. 3 is a view used for explaining how paper travels through the paper transportation unit.

In the printer 1, the paper transportation unit 12 is installed under the recording head unit 30. The paper transportation unit 12, as shown in FIG. 3, includes a drive roller 121, an upstream-side driven roller 122, a downstream-side driven roller 123, an upstream-side transportation belt 124, a downstream-side belt 125, and a transportation motor (not shown). When the drive roller 121 of the paper transportation unit 12 is rotated, the upstream-side belt transportation 124 and the downstream-side transportation belt 125 move. So, when the paper S supplied from the paper supply unit 11 contacts the upstream-side transportation belt 124, the paper S is transported in a transportation direction to the downstream side using the frictional force between the upstream-side transportation belt 124 and the paper S. At the driver roller 121, the paper S also contacts the downstream-side transportation belt 125. Accordingly, at the location of the driver roller 121, the paper S is transported in the transportation direction to a downstream side by frictional force between the downstream-side transportation belt 125 and the paper S.

The drive signal generation circuit 20 functions as a drive signal generation unit which generates a drive signal that causes the ink to be ejected. The drive signal is supplied to a recording head 32 provided in a recording head unit 30. Therefore, the drive signal is applied to a drive element provided in the recording head 32, such as a light emitting element or piezo element, (not shown).

Figure 5:
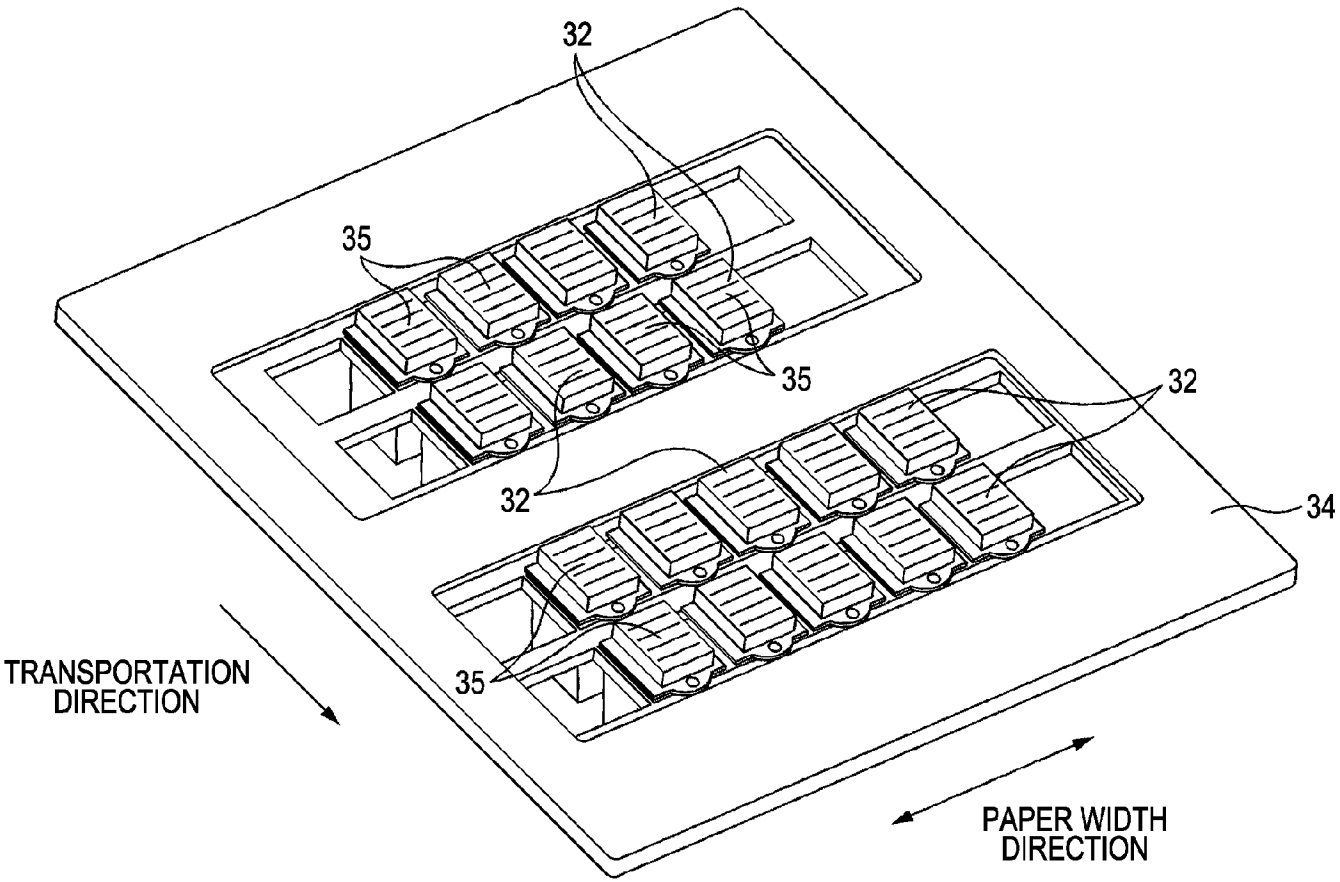
FIG. 5 illustrates an installed recording head.

The recording head unit 30 includes a recording head control unit 31 and a recording head 32. The recording head control unit 31 controls application of the drive signal to the drive element. The recording head control unit 31 in the present embodiment applies a necessary portion of the drive signal to the drive element on the based on a recording head control signal sent by the printer controller 70. The recording head 32 is a section which ejects ink. As shown in FIG. 5, the recording head unit 30 according to the present embodiment includes a plurality of recording heads 32 each including nozzle columns 35 arranged over the full width of the paper. This recording head unit 30 will be described more below.

The ink supply mechanism 40 supplies ink to the plurality of recording heads 32 provided in the recording head unit 30. As shown in FIG. 1A, the ink supply mechanism 40 includes two kinds of ink storage units, including a ink cartridge 41 and built-in ink tank 43, and a liquid route selection unit 45. The ink cartridge 41 and the built-in ink tank 43 store the same kind of ink that is ejected from the recording head 32. As described above, the printer 1 performs a printing operation by using four colors of ink. For this reason, each of the ink cartridge 41 and the built-in ink tank 43 stores four colors of ink. The ink supply mechanism 40 will be described more below.

The ink recovery mechanism 50 recovers ink ejected from the plurality of recording heads 32. The ink recovery mechanism 50 includes a cap unit 51, a suction pump 52, etc. The ink recovery mechanism 50 also will be described more below.

The detector group 60 includes a plurality of detectors which monitor the status of the printer 1. The plurality of detectors includes an ink remaining amount sensor 61 (see FIG. 4) for detecting when the amount of ink remaining in the built-in ink tank 43 falls below a predetermined amount. The ink remaining amount sensor 61 outputs an ink remaining signal when the ink stored in the built-in ink tank 43 falls below the predetermined amount which is sent to the printer controller 70.

The printer controller 70 is the central controller of the printer 1. The printer controller controls each part of the printer based on the printing data received from a computer CP and the detection results from the detector group 60 and uses the data and results in order to print an image on the paper S. For example, the printer controller outputs a transportation signal to the paper transportation mechanism 10 to transport the paper S. The printer controller outputs a pressure signal and a selection signal to the ink supply mechanism 40 to supply ink to each of the recording head 32. The printer controller outputs a capping signal and a suction signal to the ink recovery mechanism 50 to recover ink exhausted from the recording heads 32. The printer controller 70 functions as a section-and-supply unit by interacting with a liquid passage selection unit 45 provided in the ink supply mechanism 40, which will be described in more detail below.

The printer controller 70 includes an interface unit 71, a central processing unit (CPU) 72, and a memory unit 73. The interface unit 71 delivers data from the computer CP to the printer. The CPU 72 is an arithmetic processing unit performing overall control in the printer 1. For example, the CPU 72 sends a recording head control signal to the recording head unit 30 and sends a drive signal generation command to the drive signal generation circuit 20. The memory unit 73 stores various kinds of information used in the CPU 72.

As shown in FIG. 1B, a portion of the memory unit 73 is utilized as a program storage domain for storing computer programs. The rest of the memory unit is used as an ejection counter domain used for counting the number of times that an ink ejection process is performed along with an ejection amount table. The ejection counter domain is provided for each ink color, or each type of liquid, and counts the number of times that an ink ejection process is performed for each of colors when the ink is supplied from the ink cartridge 41 to the recording head 32.

The ejection amount table has ejection amount information which shows the relationship between the number of times of an ink ejection process is performed and amount of ink that is ejected with each process. There are many kinds of ejection amount information. For example, the ejection amount information is information relating to an amount of ink which is ejected by a single time of ink ejection operation. Alternatively, the ejection amount information may be information relating to an amount of ink which is ejected per 1000 ink ejection operations. In other words, the ejection amount information may be any kinds of information so long as it shows the relationship between the number of times of ink ejection operation and the amount of ink that is ejected in those ejection operations.

The printer controller 70 (CPU 72) can identify the amount of ink of each color that has been used based on the ejection amount information stored in the ejection counter domain. An initial storage amount of the ink in the ink cartridge 41 is first given. For this reason, the printer controller 70 can identify the amount of ink (remaining amount of liquid) stored in the ink cartridge 41 on the based and the amount of ink that is subsequently used in ejection operations.

Main Parts of the Printer 1

Recording Head Unit 30

As shown in FIG. 4, the recording head unit 30 includes a frame 33. As shown in FIG. 5, a plurality of recording heads 32 are attached to an installation board 34. The installation board 34 with the plurality of recording heads 32 is attached to the frame 33. Each of the recording heads 32 provided in the recording head unit 30 includes a plurality of nozzles. The nozzles eject ink. The plurality of nozzles is grouped so that the groups correspond to the kinds of ink to be ejected. The nozzles are arranged at predetermined pitches in a predetermined direction in order to form a plurality of nozzle columns 35. FIG. 5 shows the nozzle columns 35. The nozzle columns 35 are provided so as to correspond to colors of ink. In the state in which the installation board 34 is attached to the frame 33, a plurality of nozzles belonging to a certain nozzle column 35 are arranged in a direction corresponding to the width of the paper S. The width of the paper S is orthogonal to the transportation direction of the paper S.

In the printer 1, since four colors of ink are ejected, a single recording head 32 is provided with four nozzle columns 35. The plurality of nozzle columns 35 provided in a single recording head 32 are arranged and spaced from each other by predetermined distances in the transportation direction. The recording heads 32 are arranged with appropriate shift from each other so that the nozzles are arranged at regular intervals over the full length of the paper S in the widthwise direction of the paper S. Accordingly, it is possible to print an entire image on the paper S in a single paper transportation process. That is, the printer 1 is a line recording head printer employing a plurality of recording heads 32.

Ink Supply Mechanism 40

As shown in FIG. 1A, the ink supply mechanism 40 includes an ink cartridge 41, a cartridge pressure pump 42, a built-in ink tank 43, an ink pressure pump 44, and a liquid passage selection unit 45.

Figure 6:
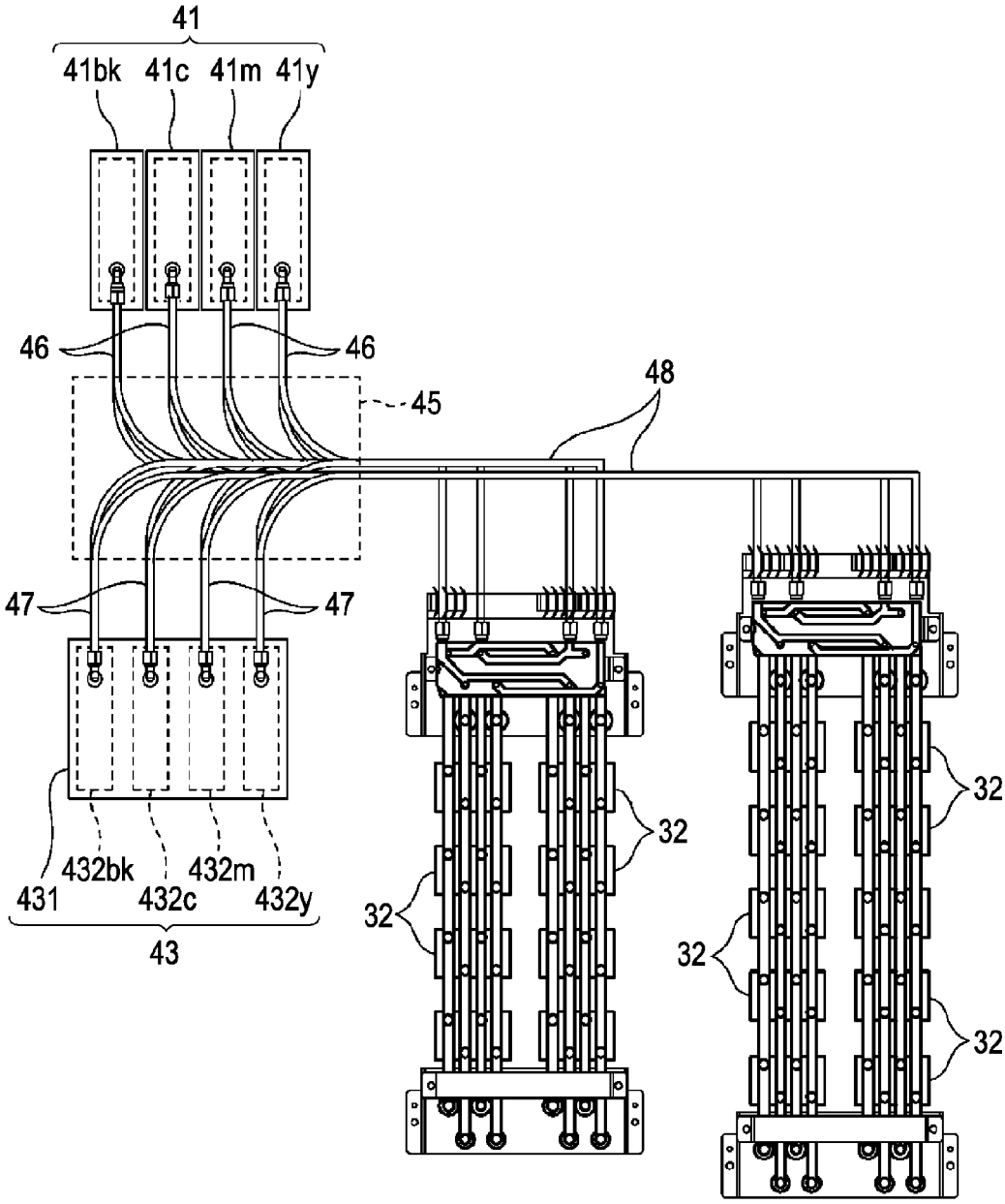
FIG. 6 illustrates the ink supply mechanism of the invention.

The ink cartridge 41 is an ink storage unit which stores ink and is installed in a replaceable manner by a user. As a matter of convenience, the part of the apparatus that is separate from the ink cartridge 41 is called a body of the printer 1. The body corresponds to an apparatus body of the liquid ejection apparatus. As shown in FIG. 4, the ink cartridge 41 includes a case 411 and an ink pack 412 received in the case 411. The inside of the case 411 is sealed and the ink pack 412 is pressurized via a valve (not shown) installed in the case 411. The ink cartridges 41 are provided for each of colors of ink to be ejected. Accordingly, as shown in FIG. 6, the ink cartridges 41 comprise a black ink cartridge 41*bk* for storing black ink, a cyan ink cartridge 41*c* for storing cyan ink, a magenta ink cartridge 41*m* for storing magenta ink, and a yellow ink cartridge 41*y* for storing yellow ink. These ink cartridges 41*bk*, 41*c*, 41*m*, and 41*y* are installed in a replaceable manner with respect to an apparatus body and comprise first liquid storage units capable of storing liquid to be ejected from the recording heads 32.

Each of the ink cartridges 41 communicates with one end of each of first ink tubes 46. The first ink tubes 46 are installed so as to correspond to the four ink cartridges 41*bk*, 41*c*, 41*m*, and 41*y*. That is, the first ink tubes 46 are installed for each of colors of ink (for each of kinds of liquid). An ink passage provided in the first ink tube 46 corresponds to a first liquid passage in which the liquid stored in the first liquid storage unit flows. Further, a remaining end of the first ink tube 46 is connected with an end of a common ink tube 48. A remaining end of the common ink tube 48 is connected with the recording head unit 30. The common ink tube 48 will be described in more detail below.

The cartridge pressure pump 42 is used for putting a pressure to ink in the ink cartridge 41. In the printer 1, the ink stored in the ink cartridge 41 is supplied to the recording head unit 30 via the first ink tube 46 and the common ink tube 48. In the case in which the ink is supplied via the first ink tubes 46 and the common ink tube 48, it is possible to consistently supply the ink to the recording head unit 30 by creating a pressure difference between the ink cartridge 41 and the recording head unit 30. The cartridge pressure pump 42 creates pressure on the inside of the case 411 of the ink cartridge 41. The cartridge pressure pump 42 operates in response to a pressure signal from the printer controller 70.

The built-in ink tank 43 is an ink storage integrally formed with the body of the printer 1 that is capable of storing ink. The built-in ink tank 43 includes a case 431 and an ink pack 432 similar to the ink pack 431 of the ink cartridge 41. Further, the ink pack 432 is pressurized by putting a pressure on the inside of the case 431. The ink pack 432, as shown in FIG. 6, stores each of colors. That is, there is a black ink pack for 432*bk* storing black ink, a cyan ink pack 432*c* for storing cyan ink, a magenta ink pack 432*m* for storing magenta ink, and a yellow ink pack 432*y* for storing yellow ink.

The built-in ink tank 43 stores the same kind of ink (interchange ink) as the ink stored in the ink cartridge 41. The ink pack 432 of the built-in ink tank 43 is mounted during the manufacturing process of the printer body 1. Thus, the ink pack 432 can not be replaced by a user. However, since the ink pack 432 is arranged within an empty space of the printer 1, the ink pack 432 has sufficient capacity.

The built-in ink tank 43 is integrally formed with the apparatus body, and corresponds to a second liquid storage unit which stores the same kind of ink to be ejected from the recording head 32 as the ink stored in the first liquid storage unit.

As shown in FIG. 6, each of the ink packs 432*bk*, 432*c*, 432*m*, and 432*y* provided in the built-in ink tank 43 are connected with one end of a second ink tube 47. Ink passages provided in the second ink tubes 47 correspond to a second liquid passage in which the ink stored in the second liquid storage unit flows. Further, remaining ends of the second ink tubes 47 are connected with the end of the common ink tube 48 along with the remaining ends of the first ink tubes 46. Accordingly, an ink passage provided in the common ink tube 48 functions as both the first liquid passage and the second liquid passage. In other words, the ink passage in the common ink tube 48 functions as a common liquid passage.

The tank pressure pump 44 is used for pressurizing ink in the built-in tank 43. The process for pressurizing the ink will be omitted because it is the same as in the ink cartridge 41. Accordingly, the tank pressure pump 44 must apply an ink supply pressure and pressurizes the inside space of the built-in ink tank 43 with air. The built-in ink tank 43 operates in response to a pressure signal from the printer controller 70.

Figure 7:
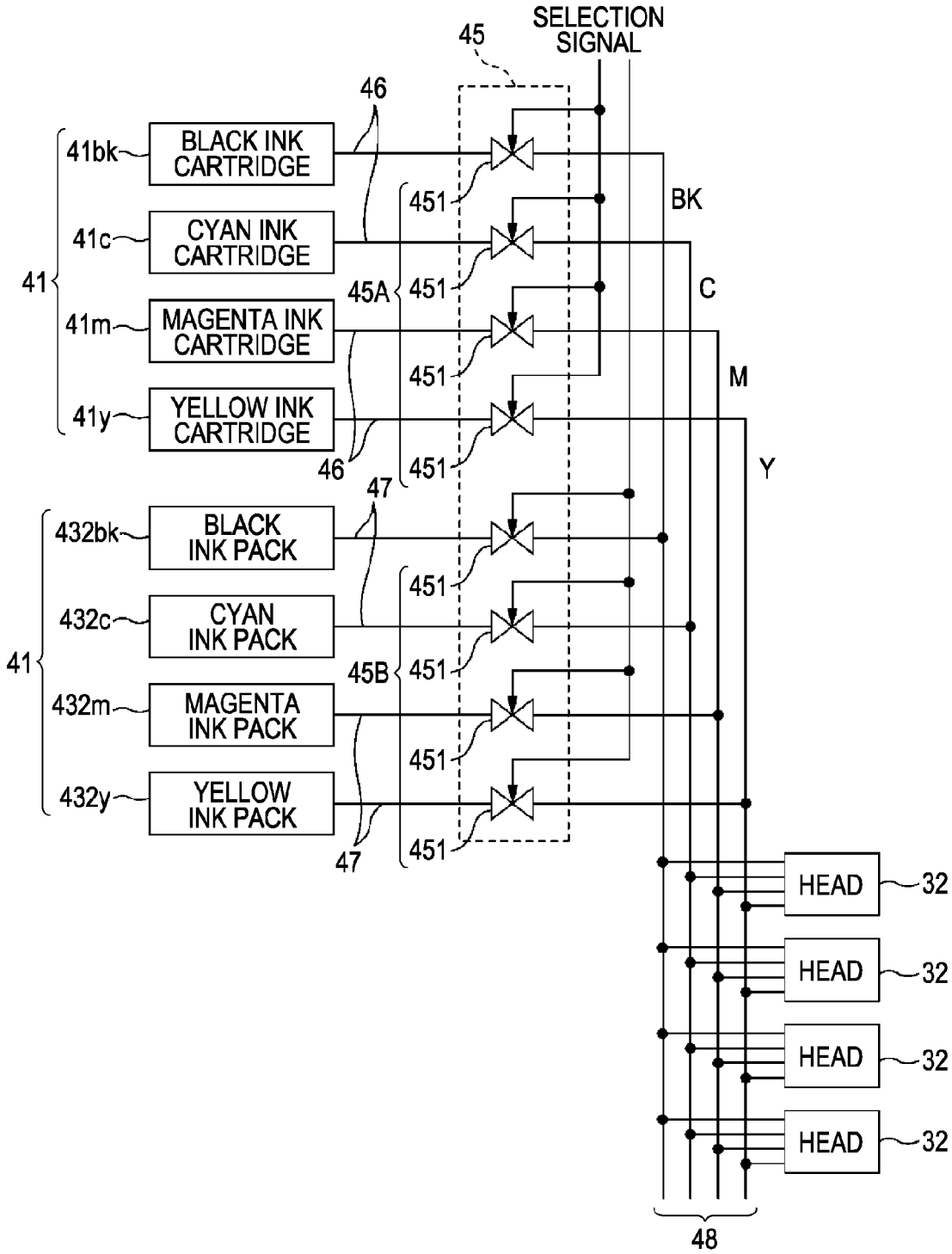
FIG. 7 is a block diagram illustrating a liquid passage section unit.

The liquid passage selection unit 45 determines an ink passage route so that one route between the ink stored in the ink cartridge 41 and the ink stored in the built-in ink tank 43 is selected and the selected ink is supplied to the unit recording head 30. As shown in FIGS. 6 and 7, the liquid selection unit 45 is installed up-stream from the common ink tube 48, i.e. near the ink cartridge 41 or the built-in ink tank 43. That, is it is installed on a portion of an individual liquid passage of the first liquid passage and the second liquid passage.

As shown in FIG. 7, the liquid passage selection unit 45 includes a plurality of valves 451 installed in the middle of the ink tubes 46 and 47, respectively. These valves 451 stop or allow the ink in the tubes 46 and 47. The printer 1 includes four valves 451 for each color near the ink cartridges 41. In similar manner, valves 451 are installed in the middle of the second ink tubes 47 near the built-in ink tank 43. In the following description, four valves 451 installed in the middle of the first ink tubes 46 (first liquid passage) are referred to as a first valve group 45A and the four valves 451 installed in the middle of the second ink tubes 47 (second liquid passage) are referred to as the second valve group 45B.

Accordingly, it is possible to select the ink to be supplied to the recording head unit 30 by controlling the first valve group 45A and the second valve group 45B. For example, when the first valve group 45A corresponding to any one color of ink is in an open state and the second valve group 45B is in a closed state, the ink stored in the ink cartridge 41 can be supplied to the recording head unit 30. Conversely, when the first valve group 45A is in a closed state and the second valve group 45B is in an open state, the ink stored in the built-in ink tank 43 can be supplied to the recording head unit 30. When both of the first valve group 45A and the second valve group 45B are in an open state, the ink stored in both the ink cartridge 41 and the built-in ink tank 43 can be supplied to the recording head unit 30. In addition, when both the first valve group 45A and the second valve group 45B are closed, the ink stored in the ink cartridge 41 and the ink stored in the built-in ink tank 43 cannot be supplied to the recording head unit 30.

Operations of the first valve group 45A and the second valve group 45B can be externally controlled. In the printer 1, each of the valves 451, as shown in FIG. 1A, are controlled in response to a selection signal from the printer controller 70. That is, the valves are switched between the open state and the closed state. Accordingly, the printer controller 70 corresponds to a controller controlling operations of the first valve group 45A and the second valve group 45B.

The liquid passage selection unit 45 (first valve group 45A and second valve group 45B) comprise an ink passage route. The pressure pump (cartridge pressure pump 42 and tank pressure pump 44) create a pressure difference for supplying ink, and the printer controller 70 controls the ink passage route and the pressure pump, such that at least one between the ink stored in the ink cartridge 41 (first liquid storage unit) and the ink stored in the built-in ink tank 43 (second liquid storage unit) is selected to supply ink to the recording head unit 30. Thus, the printer control 70 comprises a selection-and-supply unit which supplies ink to the recording head unit 30.

As described above, the ink cartridge 41 is installed in a replaceable manner with respect to the body, but the built-in ink tank 43 is integrally formed with the body. That is, the built-in tank is installed in a manner such that it cannot be replaced by a user. Accordingly, the capacity of the built-in ink tank 43 is larger than that of the ink cartridge 41 (even though the built-in ink tank 43 and the ink cartridge 41 are shown such that they have almost the same capacity in FIGS. 4 and 6, for convenience sake). In greater detail, the capacity of the ink cartridge 41 is about 15 ml, and the capacity of the built-in ink tank 43 is about 250 ml.

As described below, the ink stored in the built-in ink tank 43 is used for maintenance operations, such as the suction cleaning and flushing of the nozzles. Accordingly, the capacity (250 ml) of the built-in ink tank 43 depends on the amount of number maintenance operations that are expected to be performed in the lifespan of the printer 1. That is, the capacity takes into consideration the amount of ink consumed by all the maintenance operations that will likely be performed in the entire lifespan of the printer 1.

Since the capacity of the built-in ink tank 43 is based on the assumed consumption, the ink in the built-in ink tank 43 may run out of before the lifespan of the printer 1 is terminated. Accordingly, when the ink in the built-in ink tank 43 runs out, since the amount of ink in the ink tank 43 is detected by the remaining amount sensor 61, the printer controller 70 which received the detection signal sends an error message to a user. The error message, for example, is sent to the user by the means of a printer driver installed in the computer CP. Alternatively, the message may be sent to a user by the means of a display unit (not shown) of the printer 1. In such a case, since the built-in ink tank 43 cannot be replaced with a new one by a user, the built-in ink tank 43 can be replaced or replenished in a maintenance service.

Ink Recovery Mechanism 50

As shown in FIG. 1A, the ink recovery mechanism 50 includes a cap unit 51, a suction pump 52, and an ink recovery unit 53.

The cap unit 51 includes a plurality of caps 511. As shown in FIGS. 2, 3, and 4, each of the caps 511 is arranged at a location which faces the nozzle surface of the recording head 32. In the printer 1, each of the caps is installed between the transportation belts 124 and 125 of the paper transportation mechanism 10. Each of the caps 511 is a member having a box shape and having a surface facing the nozzles which is open so as to receive ink discharged from the recording head 32. The cap unit 51 is used during a maintenance period of nozzles of the recording head 32, which is the period for normalizing operation of the recording head 32. That is, each of the caps 511 receives the ink ejected during a flushing period, during which ink in the nozzles is forcedly ejected. Moreover, each of the caps 511 contacts the nozzle surface during a suction cleaning period in which the ink in the recording head 32 is forcedly ejected. For this reason, the cap unit 51 is installed in a movable manner both towards and away from the recording head unit 30. The flushing and the suction cleaning are mainly performed in order to remove thickened ink from the ink recording head 32. Further, the flushing and the suction cleaning are performed in order to discharge air bubbles.

The suction pump 52 is used for the suction cleaning and reduces the pressure of the inner space of the caps 511. A tube pump is one example of the suction pump 52 that may be used. In this embodiment, as shown in FIG. 4, the number of suction pumps 52 is equal to the number of caps 511.

The ink recovery unit 53 recovers ink received from the caps 511, and includes an absorbent which absorbs liquid and a case encasing the absorbent (not shown). The caps 511 are connected with each other by a tube.

The ink recovery unit 53 is integrally formed with the body so that it cannot be replaced by a user like the built-in ink tank 43. Since the ink which is used for the maintenance operation of the nozzles is recovered to the ink recovery unit 53, the capacity of the ink recovery unit 53 depends on the amount of ink that is assumed to supply the number of maintenance operations that will be performed in the lifespan of the printer 1, like the capacity of the built-in ink tank 43. That is, the size of the ink recovery unit 53 depends on the amount of ink to be consumed in all the maintenance operations in the lifespan of the printer 1. However, since a separate ink recovery unit 53 is not provided for each color of ink (many kinds of ink are recovered to the common ink recovery unit 53), the capacity of the ink recovery unit 53 is a multiple of the capacity of each color tank in the built-in ink tank 43. That is, the capacity of the ink recovery unit 53 is about 1000 ml.

In this way, the ink recovery unit 53 becomes full when the last of the ink in the built-in ink tank 43 is used. Accordingly, when the ink in the built-in ink tank 43 runs out of ink and is refilled or replaced, the ink recovery unit 53 may be replaced or drained.

In consideration of ink evaporation, the capacity of the ink recovery unit 53 may be set to be smaller than the assumed capacity. Since a half of the ink evaporates during the flushing or cleaning operations, the capacity of the ink recovery unit 53 may be set to a multiple of the capacity of the built-in ink tank 43 (such as one half of four times the capacity of one color tank in the built-in tank 43, in this embodiment). That is, the capacity of the ink recovery unit 53 may be about 500 ml. When comparing the case wherein the capacity of the ink recovery unit 53 is 1000 ml and the case in which the capacity of the ink recovery unit is 500 ml, the former case is advantageous in that it is possible to completely recover the ink regardless of the amount of ink that evaporates. On the other hand, the later case is advantageous in that it is possible to save the installation space.

Operation of Printer 1

Brief Overview

In the printer 1, the same kind of ink is stored in the ink cartridge 41 and the built-in ink tank 43. Accordingly, the printer controller 70 and the liquid selection unit 45 (selection-and-supply unit) select an ink from the ink stored in the stored in the ink cartridge 41 and the ink stored in the built-in ink tank 43 and supplies the selected ink to the recording head unit 30.

For example, the printer controller 70 supplies the ink stored in the ink cartridge 41 to the recording head unit 30.

During the maintenance operation (flushing, suction cleaning) period of the printer 1, the ink of the built-in ink tank 43 is supplied to the recording head unit 30. Further, in the case in which the remaining amount of ink in the ink cartridge 41 becomes a predetermined amount or less by which the replacement of the ink cartridge 41 is needed, it is possible to supply the ink to the recording head unit 30 from the built-in ink tank 43 even during a printing period.

Operation

Figure 8:
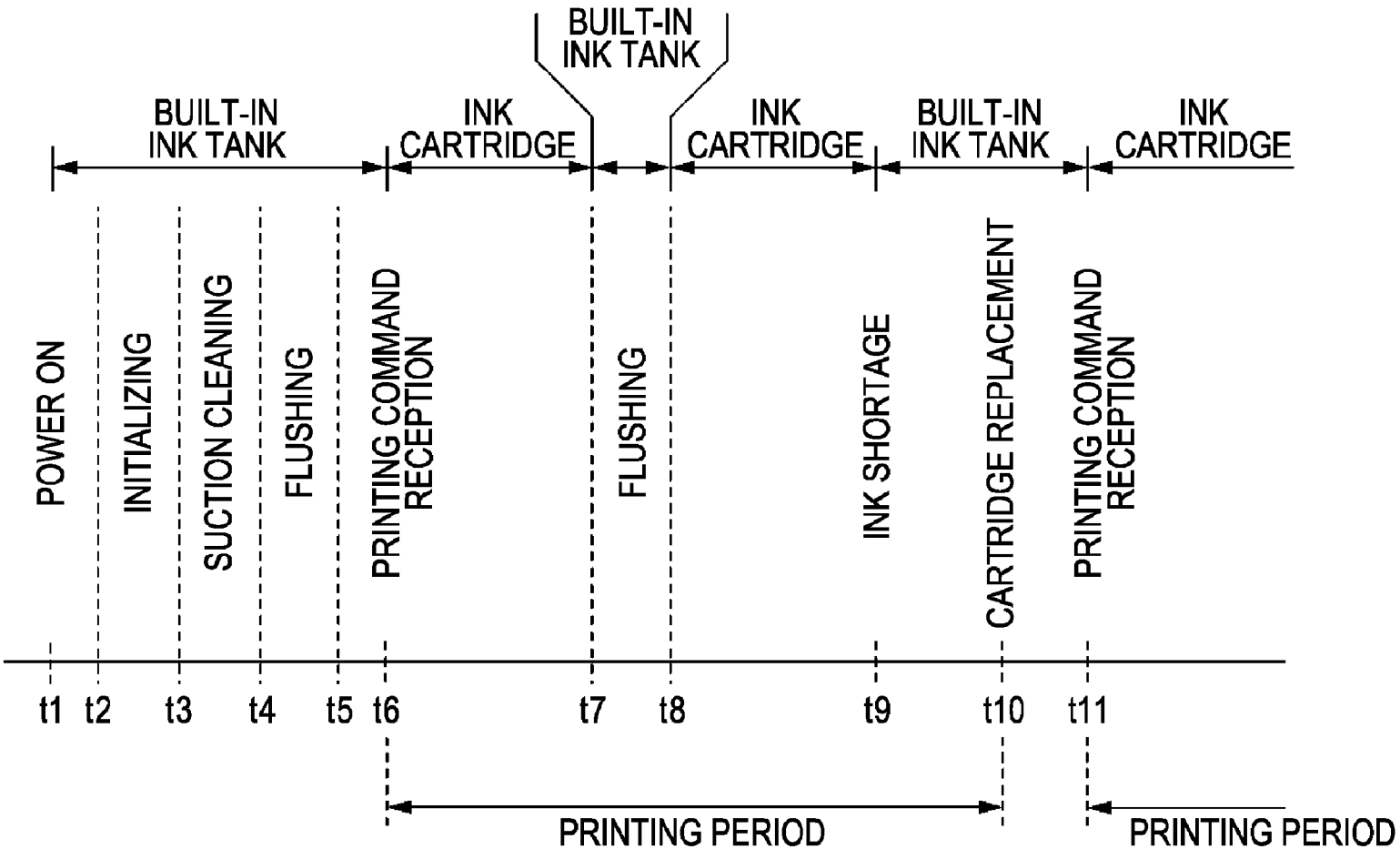
FIG. 8 illustrates the printer of an embodiment of the invention.

FIG. 8 shows an operation of the printer 1. This operation is performed in a manner such that the CPU 72 of the printer controller 70 controls each part of the printer 1 according to a computer program stored in the memory unit 73. For this reason, the computer program includes codes for performing the various processes.

In the exemplified operation, when the printer 1 is powered on (t1), an initializing operation is performed (from t2 to t3). During this initializing operation, an initial setting with respect to the printer 1 is performed. For example, program reading and power checking operation may be performed respect to all parts. After the initializing operation, a suction cleaning process is performed (from t3 to t4). The suction cleaning process is an operation for sucking out the ink from the recording head 32, and is a kind of the maintenance operation for the nozzles. During the suction cleaning process, the printer controller 70 brings the caps 511 into contact with the nozzle surface of the recording head 32 and then starts the suction pump 52. After the suction cleaning process, a flushing process is performed (from t4 to t5). The flushing process is an operation for discharging ink from the nozzles and is another kind of maintenance operation for the nozzles. During the flushing process, the printer controller 70 applies a drive signal for the flushing process in order to a drive element provided in the recording head 32. In this process, the drive element operates so as to discharge the ink, and ink is discharged from the nozzles.

Preparation for printing with respect to the paper S is finished by the flushing process. Accordingly, the printer controller 70 receives a printing command from the computer CP. When the printing command is received (t6, t11), a printing process is performed (t6 and t7, t8 to t10, and from t11).

Ink Selection

By the above mentioned operation, the ink supplied to the recording head unit 30 is selected in response to the type of operation performed in the printer 1. Hereinafter, ink selection processing will be described. Since the suction cleaning and the flushing are kinds of nozzle maintenance operations, the ink consumed during this time is not used for image printing. If the ink stored in the ink cartridge 41 is used for such maintenance operation, the replacement of the ink cartridge 41 is more frequent, and thus it becomes inconvenient to use the printer 1. In particular, as shown in FIG. 5, the plurality of recording heads 32 is provided. For this reason, the ink consumption is increased in proportion with the number of recording heads 32. In particular, since the ink cartridge 41 to be replaced is purchased by a user, it is possible to decrease the frequency that the ink cartridge 41 will have to be replaced.

Figure 9A:
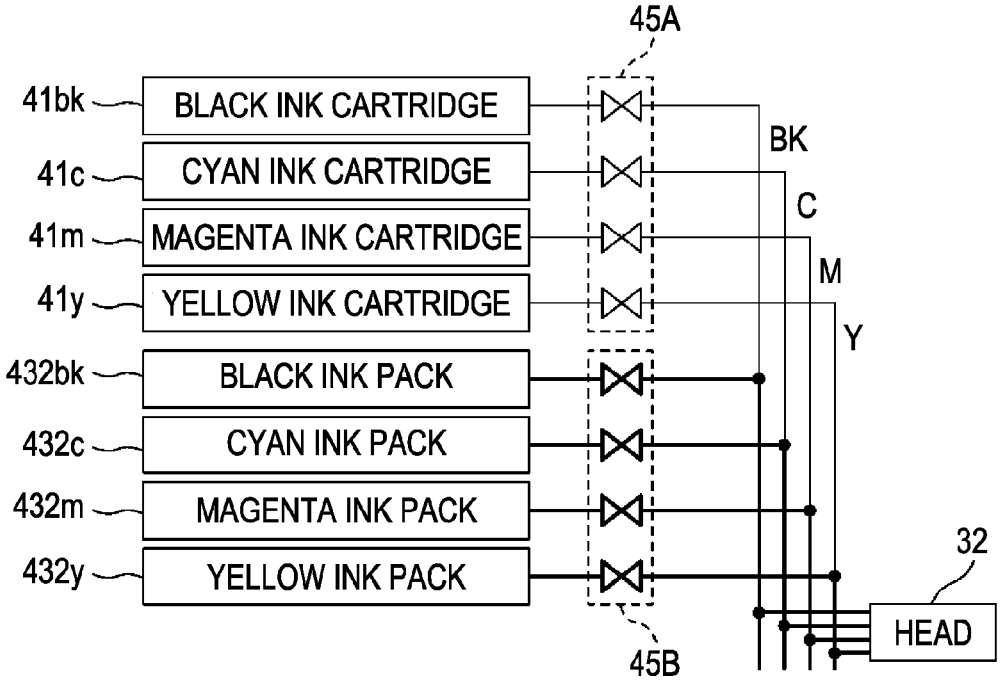
FIG. 9A illustrates a second valve group in an open state.

In the printer 1, it is possible to use the ink stored in the built-in ink tank 43 during a maintenance operation. According to an exemplary operation shown in FIG. 8, the ink stored in the built-in ink tank 43 is supplied to the recording head unit 30 during the period between the power-on and the reception of the printing command (from t1 to t6). In this case, as shown in FIG. 9A, the printer controller 70 sends a selection signal to the liquid passage selection unit 45, which opens the second valve group 45B, and closes the first valve group 45A. As a result, the ink of the same amount as the ink used for the maintenance operation is supplied from the built-in ink tank 43 to the recording head unit along the path illustrated by a thick solid line in FIG. 9A.

The maintenance operations are often performed in the middle of the printing operation. For example, in the case in which printing with respect to a plurality of sheets of paper S is performed, the nozzle maintenance operation may be performed between printing the individual sheets of paper S and starting of printing with respect to a next sheet of paper S. In the exemplary operation shown in FIG. 8, the flushing operation is performed at the timing ranging from t7 to t8. Accordingly, the ink supply route is switched so that the ink stored in the built-in ink tank 43 is supplied to the recording head unit 30 during the flushing operation.

Figure 9B:
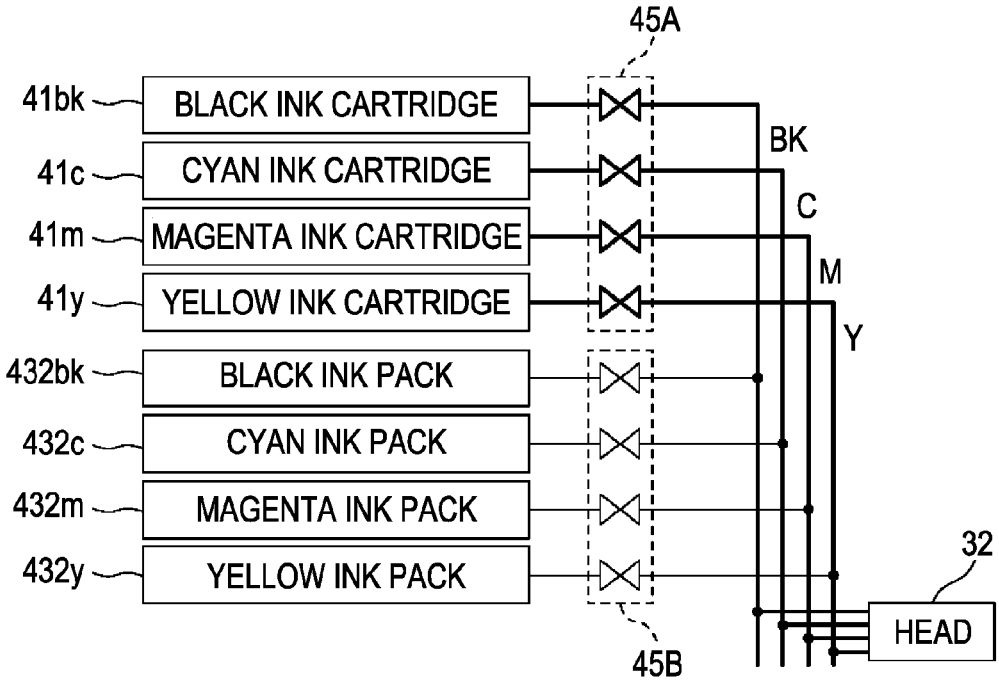
FIG. 9B illustrates a first valve group in an open state.

In the printing period during which the ink is used in a printing operation on the paper S (image printing), the ink stored in the ink cartridge 41 is supplied to the recording head unit 30. In the operation shown in FIG. 8, the ink stored in the ink cartridge 41 is supplied to the recording head unit 30 at the time ranging from t6 to t7, the timing ranging from t8 to t9, and at the timing after t11. In this case, as shown in FIG. 9B, the printer controller 70 sends the selection signal to the liquid passage selection unit 45, which opens the first valve group 45A, and closes the second valve group 45B. By this operation, the ink of the same amount as the ink used for a printing operation is supplied from the ink cartridge 41 along the path illustrated by a thick sold line.

On the other hand, there is the possibility that the ink in the ink cartridge 41 running out during the period of the printing operation with respect to the paper S. In printers currently known in the art, this causes the printing operation to be interrupted, and a message of notifying the need of replacement of an ink cartridge is sent to a user. However, the interruption of the printing likely irritates a user who wants to get a copy of printing rapidly. In particular, the known printer is troublesome in the case in which a user does not have a new ink cartridge on hand, because the printing cannot be performed until the user buys a new ink cartridge and installs the new ink cartridge.

In the printer 1 according to the embodiment of the invention, when the ink in the ink cartridge 41 runs out during the printing operation, the ink supply route may be switched and the ink in the built-in ink tank 43 may supplied to the recording head unit 30. In the example shown in FIG. 8, the remaining amount of ink is detected at the timing of t9. As described above, the remaining amount of ink is identified by the printer controller 70 (CPU 72) on the based of the ejection amount information stored in a table showing the relationship between the number of counts stored in an ejection counter domain and an ejection amount. Accordingly, the remaining amount of ink can be obtained at random intervals even in the middle of the printing operation.

Therefore, the printer controller 70 outputs the selection signal to the liquid passage selection unit 45 without interrupting the printing when the remaining ink is insufficient. Here, the selection signal makes the second valve group 45B open and closes the first valve group 45A. With such operation, the ink stored in the built-in ink tank 43 is used for the printing. After the printing operation responding to the printing command is finished, the printer controller 70 sends a message encouraging a user to replace the ink cartridge 41. This message is delivered to the user by the means of the printer driver installed in the computer CP. Alternatively, the message may be delivered to the user by the means of a display unit (not shown) of the printer 1.

In this manner, even though the amount of ink stored in the ink cartridge 41 is depleted, since the ink stored in the built-in ink tank 43 can be used as the substitution of the ink of the ink cartridge 41, it is possible to complete the executed corresponding printing operation without interruption. For this reason, a user can obtain printed material rapidly, and the convenience of the printer improves. Moreover, according to the printer 1 of the invention, it is possible to set the reference amount of ink, which is the criteria for detecting that the ink stored in the ink cartridge 41 needs to be replaced, to a smaller amount than the amount set in printers currently used in the art. This can be realized thanks to the control in which the switching of ink supplied to the heat unit 30 is performed by the first valve group 45A and the second valve group 45B. That is, if the first ink tubes 46 and the second ink tubes 47 are filled with ink, it is possible to switch the ink supply path without any trouble.

For such a reason, after the ink cartridge 41 is replaced, if the printer 1 receives a next printing command, the printer controller 70 performs the printing by switching the ink supply source to the ink cartridge 41 (from t11).

Conclusion

In the printer 1, the printer controller 70 selects the ink to be supplied to the recording head unit 30 from the ink stored in the ink cartridge 41 and the ink stored in the built-in ink tank 43. Accordingly, the ink supply route is established by controlling the first valve group 45A and the second valve group 45B according to the kind of ink to be supplied, and the ink is supplied via the established ink supply route.

In this manner, in the printer 1, since either the ink stored in the ink cartridge 41 or the ink stored in the built-in ink tank 43 may be supplied to the recording head unit 30, it is possible to improve convenience of use of the printer 1. For example, it is possible to replace the ink cartridge without interrupting a printing process or to use the ink stored in the ink cartridge 41 in a printing process.

The ink cartridge 41 is installed in a detachable manner from the body of the printer 1, and the built-in ink tank 43 is integrally formed with the body of the printer. Accordingly, it is possible to prolong the lifespan of the printer 1 by replacing the ink cartridge 41. Further, since the built-in ink tank 43 is less limited in the shape thereof than the ink cartridge 41, a redundant space of the printer 1 can be used and thus it is possible to easily secure the sufficient capacity.

Operations of the first valve group 45A used for controlling the flow of ink stored in the ink cartridge 41 and the second valve group 45B used for controlling the flow of ink stored in the built-in ink tank 43 are controlled by the printer controller 70. Accordingly, the ink supply route can be easily changed.

The printer controller 70 controls the first valve group 45A and the second valve group 45B so that the ink from the built-in ink tank 43 is supplied during a nozzle maintenance process. That is, the uses of the ink are differently determined for each ink source. For example, the ink stored in the ink cartridge 41 is mainly utilized for printing processes and the ink stored in the built-in ink tank 43 is mainly utilized in maintenance processes. In this way, it is possible to establish the relationship between the operation of the printer 1 and the consumed amount of ink, and it becomes easier to manage the ink. Moreover, it is possible to suppress the amount of ink stored in the ink cartridge 41 that is consumed during a maintenance period. Accordingly, it is possible to increase the intervals between replacing the ink cartridge 41.

Other Embodiments

According to the above mentioned embodiment, description is made with reference to the printer 1 but a liquid ejection apparatus and a liquid ejection method are also disclosed in the description. The above mentioned embodiment is provided in order to better illustrate the invention. Accordingly, the embodiments must not be construed so as to limit the invention. It is apparent that changes, modifications and alterations of the invention may be obtained without departing from the spirit or scope of the invention. Also equivalents of the invention may fall in the scope of the invention. In particular, the following embodiments also may be included in the invention.

Liquid passage selection unit 45

Figure 10:
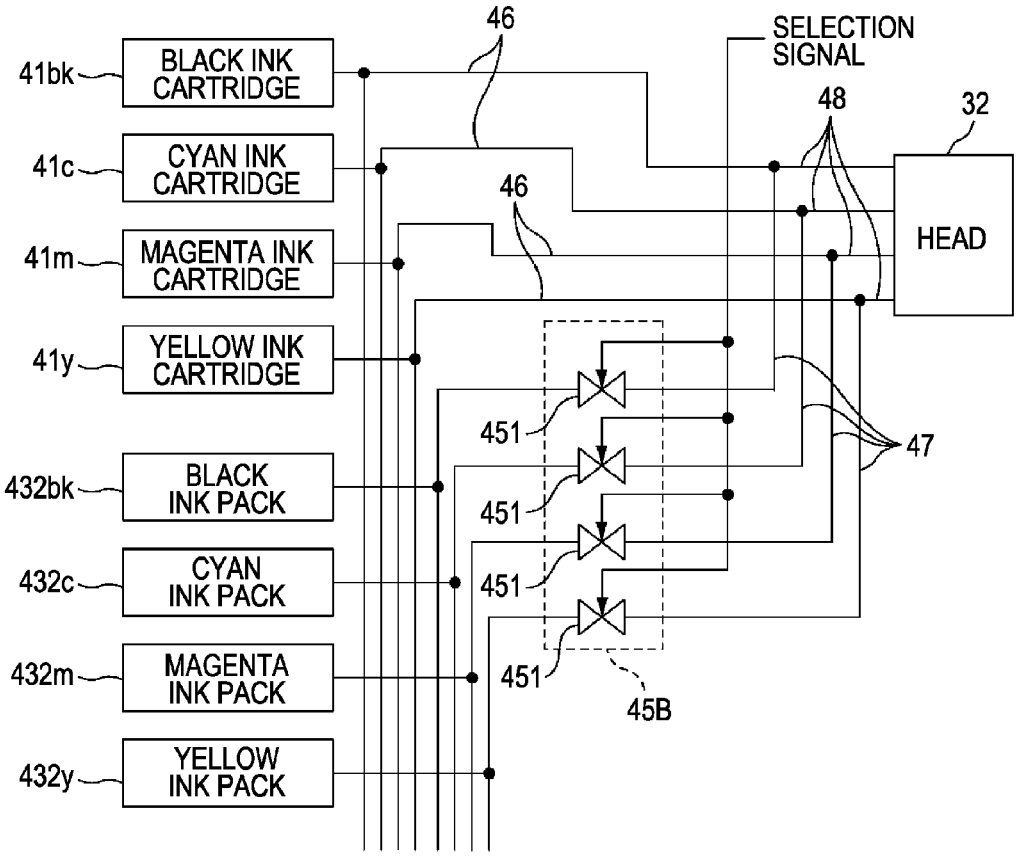
FIG. 10 illustrates an alternate embodiment of the invention.

The liquid passage selection unit 45 described above includes a first valve group 45A installed in the first ink tubes 46 and a second valve group 45B installed in the second ink tubes 47. In the liquid passage selection unit 45 shown in FIG. 10, however, only the second valve group 45B is included. In this case, the printer controller 70 causes the second valve group 45B to fall into a closed state during a printing process and causes the second valve group 45B to fall into an open state during a maintenance process.

In this manner, the ink from the ink cartridge 41 and the built-in ink tank 43 can be supplied during the maintenance period. In other words, a portion of the ink consumed during the maintenance period is supplied from the built-in ink tank 43. Accordingly, it is possible to suppress consumption of ink stored in the ink cartridge 41 during the maintenance period, and increase the intervals between replacing the ink cartridge 41.

In such a structure, it is preferable that liquid passage resistance of the second ink tubes 47 is lower than that of the first ink tubes 46. For example, tubes having a larger inner diameter may be used or tubes wherein the inside surface has water repellant characteristics may be used. In this manner, the efficiency of the ink stored in the built-in ink tank 43 and period between maintenance processes can be increased, and the ink can be aggressively used. As a result, it is possible to suppress consumption of the ink stored in the ink cartridge 41, and increase the amount of time between ink cartridge 41 replacements.

Member for Realizing Liquid Passage Selection

The liquid passage selection unit 45 of the first embodiment includes a first valve group 45A installed in the first ink tubes 46 which is used for opening the first ink tubes 46 and a second valve group 45B installed in the second ink tubes 47 which is used for opening the second ink tubes 47. The liquid passage is selected by independent operations of the first valve group 45A and the second valve group 45B. Members for achieving the liquid passage selection are not limited thereto. For example, a member can simultaneously open the first ink tubes 46 and close the second ink tubes 47 in order to select the liquid route.

Ink Tube

Figure 11:
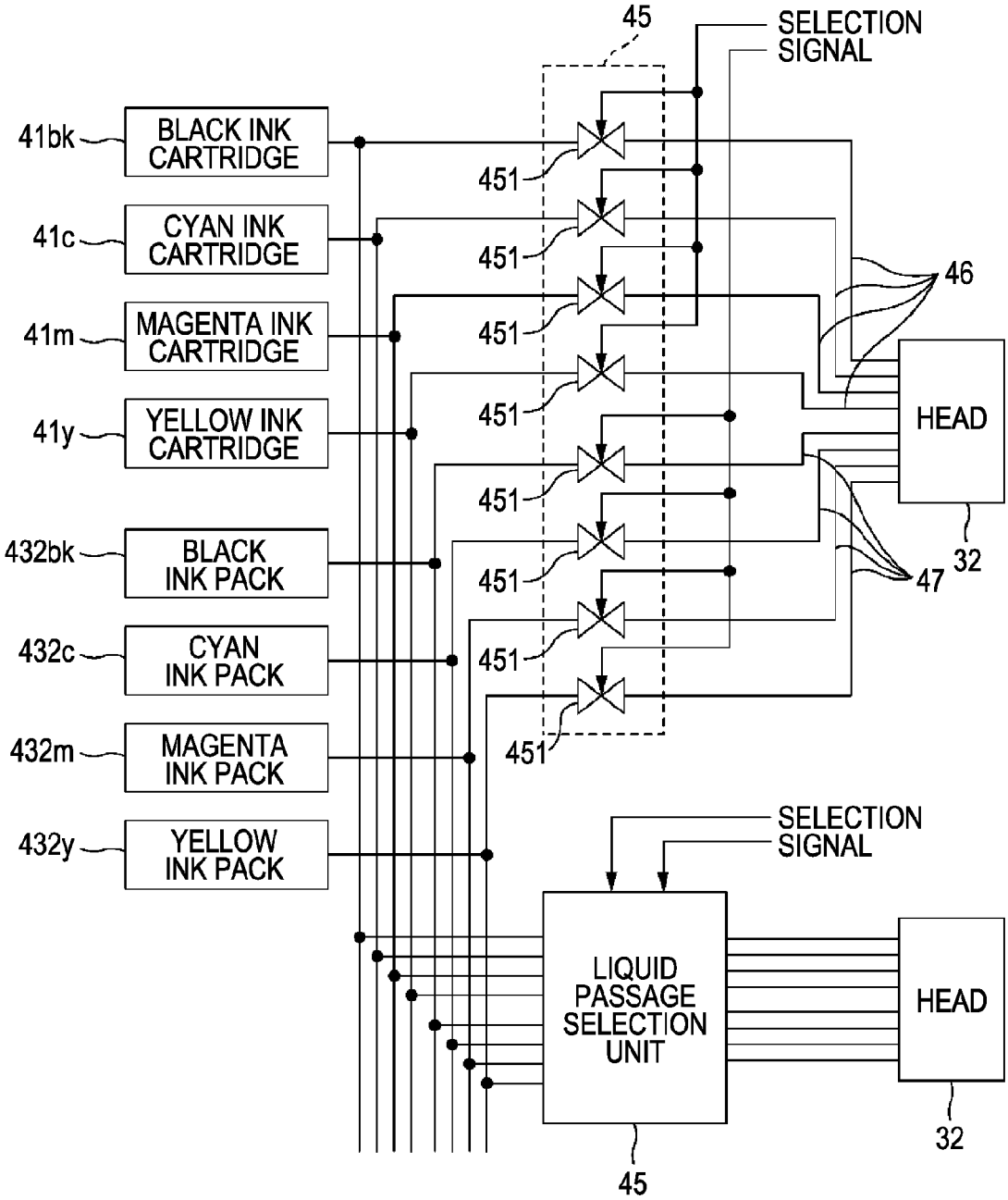
FIG. 11 illustrates another embodiment of the invention.

In the ink supply mechanism 40 according to the first embodiment, the first ink tubes 46 and the second ink tubes 47 are connected to the common ink tube 48, and the common ink tube 48 is connected to the recording head unit 30 (recording heads 32). The ink tubes are not limited to the embodiments. For example, as shown in FIG. 11, alternatively both of the first ink tube 46 and the second ink tube 47 may be connected to the corresponding recording head 32.

Replacement of Ink Cartridge 41

In the printer 1 according to the first embodiment, a message requesting the replacement of the liquid storage unit is output after the printing operation is finished (t10). Alternatively, the message, however, may be output when the shortage of ink is detected (t9). In this printer 1, the first liquid passage is closed by the first valve group 45A when the second valve group 45B is open. For this reason, it is possible to continuously perform printing while the ink cartridge 41 is being replaced. Therefore, since the ink cartridge 41 can be replaced during the printing process, it is more convenient to use the printer 1.

Ink Cartridge 41 and Built-In Ink Tank 43

In the first embodiment, the printer 1 includes a ink cartridge 41 installed in a replaceable manner with respect to a body of the printer 1 and the built-in ink tank 43 integrally formed with the body thereof is exemplified. Here, two ink cartridges 41 which store the same ink of ink can be installed. Alternatively, two built-in ink tanks 43 may be installed. That is, both of the first liquid storage unit and the second liquid storage unit may be installed in a replaceable manner, or may be integrally formed with the apparatus body. In such cases, it is preferable that either the first or second liquid storage units is used first, so that when the amount of ink remaining in one of the liquid storage units is less than a predetermined amount, the use of the apparatus may continue to perform.

Other Apparatuses

In the first embodiment described above, a line printer is used as an example of a liquid apparatus capable of performing aspects of the invention. However, the invention can be applied to a serial printer which performs printing by moving a recording head and carriage along the width of the paper.

In the embodiments, the liquid ejection apparatus may be applied to embodiments other than a printer 1. More specifically, the invention can be embodied as a liquid ejection apparatus which sprays or ejects liquid other than ink (including liquids, liquid materials in which functional material powder has been dispersed, and fluids, such as gels) or fluids other than liquid (such as solids which can be sprayed as liquid). For example, the liquid ejection apparatus of the invention may be a liquid ejection apparatus which sprays electrode material or color material used in the manufacturing process of liquid crystal displays, electroluminance (EL) displays and surface discharge displays. The apparatus may eject liquid material containing the electrode material or color material in a dissolved form, a liquid ejection apparatus which ejects bioorganic material used in manufacturing biochips, and a liquid ejection apparatus which ejects samples of liquid in a precision pipette. In addition, the liquid ejection apparatus according to the invention may be a liquid ejection apparatus which ejects a pin point amount of lubricant in a precision machinery, such as a watch and a camera, or a liquid ejection apparatus which ejects transparent resin in the form of liquid, such as ultraviolet ray curable resin used for forming micro-hemispherical lenses (optical lenses) utilized in optical communication elements. Moreover, the apparatus may eject a liquid onto a substrate, comprising a liquid ejection apparatus which ejects a liquid etchant, such as acid or alkali used for etching a substrate, or it may comprise a liquid ejection apparatus which ejects gel, or a powder ejection type recording apparatus which ejects solid in the form of power, such as toner. The invention can be applied to any one kind of the above mentioned apparatuses.

What is claimed is:

1. A liquid ejection apparatus, comprising:

a head capable of ejecting liquid;

a first liquid storage unit which is installed in the apparatus so as to be replaceable by a user, which is capable of storing the liquid to be ejected from the head;

a second liquid storage unit which is integrally formed with the apparatus body which is capable of storing liquid to be ejected from the head, the liquid stored in the second liquid storage unit being the same liquid as the liquid stored in the first liquid storage unit; and a selection-and-supply unit which is capable of selecting at least one liquid to be ejected from the head from the liquid stored in the first liquid storage unit and the liquid stored in the second liquid storage unit and supplying the selected the liquid to the head, wherein the selection-and-supply unit comprises:

a first valve installed in a first liquid passage where liquid from the first liquid storage unit flows to the recording head which is capable of stopping or allowing the flow of liquid in the first liquid passage;

a second valve installed in a second liquid passage where liquid from the second liquid storage unit flows to the recording head which is capable of stopping or allowing the flow of liquid in the second liquid passage; and a controller capable of controlling the first and second valves;

wherein the controller closes the first valve and opens the second valve to cause the liquid stored in the second liquid storage unit to be supplied to the recording head when a maintenance operation is being performed; and wherein the controller opens the first valve and closes the second valve to cause the liquid stored in the first liquid storage unit to be supplied to the recording head during a ejecting process where the recording head ejects the liquid to a medium.

2. The liquid ejection apparatus according to claim 1, wherein the controller opens the second valve while closing the first valve to cause the liquid stored in the second liquid storage unit to be supplied to the recording head during an ejecting process when the amount of liquid stored in the first liquid storage unit is detected to be below a predetermined level.

3. The liquid ejection apparatus according to claim 1, further comprising a first liquid passage in which liquid from the first liquid storage unit flows toward the recording head and a second liquid passage in which liquid from the second liquid storage unit flows toward the recording head, wherein the selection-and-supply unit includes:

a valve installed in the second liquid passage capable of allowing or stopping the flow of the liquid; and a controller capable of controlling the operation of the valve, the controller opening the valve during a maintenance operation wherein the recording head is in a normal state.

4. The liquid ejection apparatus according to claim 3, wherein resistance of the second liquid passage is lower than that of the first liquid passage.

5. The liquid ejection apparatus according to claim 1, wherein the selection-and-supply unit includes:

a valve installed in the second liquid passage capable of allowing or stopping the flow of the liquid; and a controller capable of controlling the operation of the valve, the controller opening the valve during a maintenance operation wherein the recording head is in a normal state.

6. The liquid ejection apparatus according to claim 5, wherein resistance of the second liquid passage is lower than that of the first liquid passage.

7. A liquid ejection method comprising:

selecting a liquid to be supplied to a recording head from a liquid stored in a first liquid storage unit which is installed in a replaceable manner within an apparatus body and liquid stored in a second liquid storage unit integrally formed with the apparatus body, the liquid stored in the first liquid storage unit and the liquid stored in the second liquid storage unit being the same liquid;

establishing a liquid supply route between the first and second liquid storage units and the recording head in response to the selection result of the liquid to be supplied to the recording head; and supplying the selected liquid to the recording head via the established liquid supply route.

8. A liquid ejection apparatus, comprising:

a recording head capable of ejecting liquid;

a first liquid storage unit which is installed in the apparatus so as to be replaceable by a user, which is capable of storing the liquid to be ejected from the recording head;

a second liquid storage unit which is integrally formed with the apparatus body which is capable of storing liquid to be ejected from the recording head, the liquid stored in the second liquid storage unit being the same liquid as the liquid stored in the first liquid storage unit;

a first liquid passage connecting the first liquid storage unit and the recording head;

a second liquid passage connecting the second liquid storage unit and the recording head;

a selection-and-supply unit which is capable of selecting at least one liquid to be ejected from the recording head from the liquid stored in the first liquid storage unit and the liquid stored in the second liquid storage unit and supplying the selected the liquid to the recording head by causing the selected liquid to flow from either the first or second liquid passage to the recording head.

9. The liquid ejection apparatus according to claim 8, wherein the selection-and-supply unit comprises:

a first valve installed in the first liquid passage which is capable of stopping or allowing the flow of liquid in the first liquid passage;

a second valve installed in a second liquid passage which is capable of stopping or allowing the flow of liquid in the second liquid passage; and a controller capable of controlling the first and second valves.

10. The liquid ejection apparatus according to claim 9, wherein the controller closes the first valve and opens the second valve to cause the liquid stored in the second liquid storage unit to be supplied to the recording head when a maintenance operation is being performed.

11. The liquid ejection apparatus according to claim 9, wherein the controller opens the first valve and closes the second valve to cause the liquid stored in the first liquid storage unit to be supplied to the recording head during a ejecting process where the recording head ejects the liquid to a medium.

12. The liquid ejection apparatus according to claim 11, wherein the controller opens the second valve while closing the first valve to cause the liquid stored in the second liquid storage unit to be supplied to the recording head during an ejecting process when the amount of liquid stored in the first liquid storage unit is detected to be below a predetermined level.

* * * * *